United States Patent [19]

Hengstebeck

[11] 3,931,927

[45] Jan. 13, 1976

[54] CENTRIFUGE

[75] Inventor: Robert J. Hengstebeck, Valparaiso, Ind.

[73] Assignee: Standard Oil Company, Chicago, Ill.

[22] Filed: Mar. 15, 1974

[21] Appl. No.: 451,431

Related U.S. Application Data

[63] Continuation-in-part of Ser. No. 323,212, Jan. 12, 1973, Pat. No. 3,814,307.

[52] U.S. Cl. ..... 233/19 R; 233/31

[51] Int. Cl.[2] ..... B04B 5/08; B04B 11/06

[58] Field of Search ..... 233/DIG. 1, 3, 15, 27, 233/28, 19 R, 19 A, 31, 32, 33, 37, 20 R, 20 A

[56] References Cited

UNITED STATES PATENTS

| | | | |
|---|---|---|---|
| 3,027,390 | 3/1962 | Thurman | 233/32 X |
| 3,791,575 | 2/1974 | Kartinen et al. | 233/33 X |

*Primary Examiner*—George H. Krizmanich
*Attorney, Agent, or Firm*—Claron N. White; Arthur G. Gilkes; William T. McClain

[57] ABSTRACT

A centrifuge, for separating a fluid feed into two fluids, includes a rotor shaft and a rotor housing within which is a set of concentric, equal spaced cylindrical shells providing elongated annular chambers for parallel flows of fluid. Distributor means extends radially from the shaft within one end housing portion to furnish fluid separately to the chambers. One collector means to receive one separated fluid extends radially from the shaft within the other end housing portion to communicate with the chambers. A second collector means is located preferably at the same transverse plane passing through the shaft by using radially extending walls within that end portion of the housing to divide it into a number of pie-shaped chambers, each having an outlet adjacent the shaft. Each collector means includes some of these pie-shaped chambers. In the broadest construction the total area of a set of openings of the distributor means (or of one of the collector means when appropriate) communicating with a specific annular chamber is proportional to a value between about the third power and about the fourth power of the average radius of the annular chamber. There are outlet pipes communicating with the two collector means and one of the pipes is valved to control the volume ratio of removed fluids.

23 Claims, 5 Drawing Figures

FIG. 1
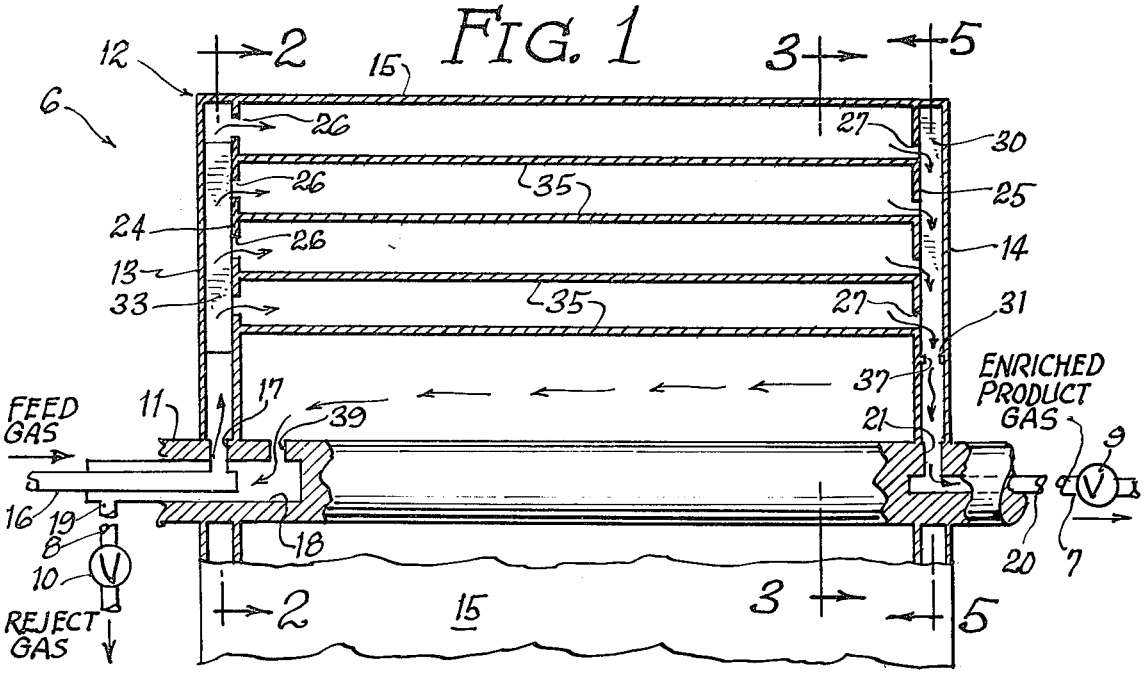
FIG. 2
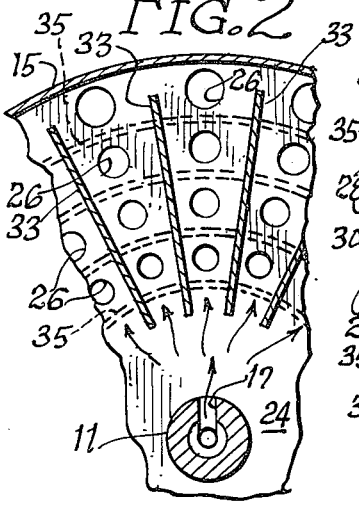
FIG. 3
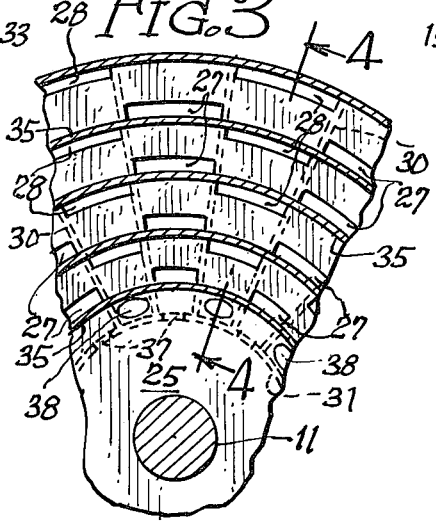
FIG. 4
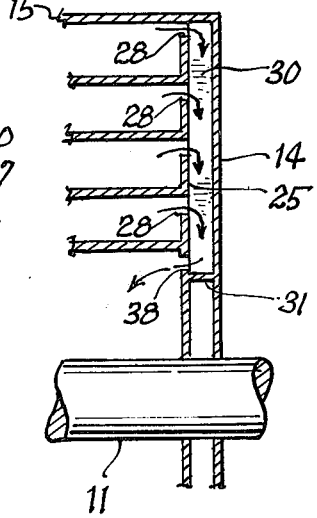
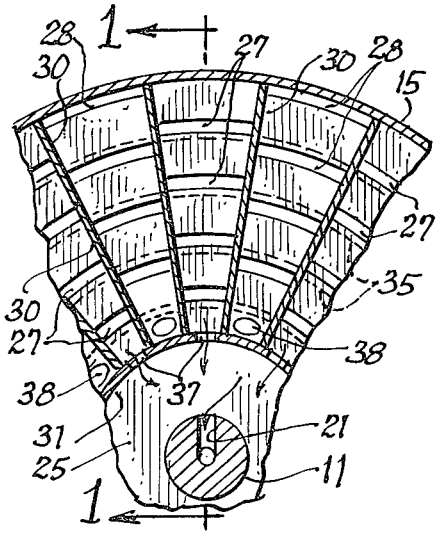
FIG. 5

CENTRIFUGE

CROSS-REFERENCE TO RELATED APPLICATION

This application is a continuation-in-part of my copending patent application Ser. No. 323,212 entitled "Centrifugal Clarifier" and filed on Jan. 12, 1973 (now U.S. Pat. No. 3,814,307, granted on June 4, 1974).

BACKGROUND OF THE INVENTION

1. Field of the Invention

This invention relates to centrifuges useful to separate a fluid mixture containing two compounds of different density such as compounds of different molecular weight. The invention is particularly useful for an enrichment separation of compounds in which one compound is present in a gaseous mixture with another compound in an amount of less than 5% for an enrichment by which there is obtained a gaseous product that contains at least a threefold greater concentration of the desired compound in that gaseous product. Thus the invention especially relates to a gas centrifuge useful to separate compounds of a natural mixture of isotopes of a chemical element in which the compounds differ in mass by a small percentage. Such use includes the enrichment of an isotope of uranium in the form of a gaseous uranium compound, e.g., separation of gaseous uranium hexafluoride made from natural uranium that contains less than 1% of $U^{235}$ isotope to obtain a gaseous product that is enriched with respect to $U^{235}$. From that product there is obtained $U^{235}$-enriched uranium having various uses including neutronic power reactors.

2. Description of the Prior Art

Centrifugal devices or apparatuses for separating solids or immiscible liquids from liquids include drum-type centrifugal clarifiers that are modifications of centrifugal contactors, solid bowl centrifuges, basket-type centrifuges, and continuous disc-type centrifuges.

A description of these types of centrifugal devices is presented in my copending patent application mentioned above. That description is hereby incorporated by reference. The description includes reference to articles in two publications, to Swedish Pat. Nos. 20754 and 20757, to U.S. Pat. Nos. 587,171, 787,950, 2,619,280, 3,027,390, 3,047,215, 3,053,440, 3,202,407, 3,344,982, 3,344,983 and 3,519,199, and to British Pat. Nos. 966,153 and 1,123,958. Two of the U.S. patents and U.S. Pat. No. 3,695,509, along with German Pat. No. 129569, were cited against my copending application mentioned above, but none of these patents and articles disclosed or would suggest a construction of a centrifugal device as claimed in that copending patent application. That claimed centrifugal device has a structure that in many respects is common with the structure of the centrifugal device of the present invention.

As pointed out in the article entitled "Enriching Europe with the gas centrifuge" in the Oct. 5, 1972, issue of *New Scientist* a gas centrifuge has been developed in Europe for the enrichment of uranium fuel. The construction of the centrifuge is not stated except to indicate that it is a centrifuge cascade and needs only 20–30 stages to obtain a product containing a typical 2.9% content of $U^{235}$. It is indicated in the article that the separation factor is increased by the 3rd and 4th power of the peripheral speed. Gas centrifuges are described at pages 21–55 in *Uranium Enrichment by Gas Centrifuge* by D. G. Avery and E. Davies, published in 1973 by Mills & Boon Limited, London, England.

SUMMARY OF THE INVENTION

This invention relates to a centrifuge that is useful for the separation of a feed fluid, that is a mixture containing two compounds, into a fluid product containing a higher concentration of one of the compounds as compared with the concentration in the initial mixture and a fluid containing a lesser concentration of that compound than in the original mixture.

The centrifuge of the present invention in one aspect has the construction of the centrifugal clarifier of my copending patent application mentioned above except for the relationship of total area of the set of openings of the distributor means or of the collector means communicating with a specific annular chamber. In the construction of this aspect of the centrifugal device of the present invention the total area of each set of openings, instead of being proportional to the square, i.e., second power, of the radial distance, is proportional to a value between about the third power and about the fourth power, preferably about the 3.5 power, of the average radius of the annular chamber to provide a linear flow of gas through each annular chamber that is similarly proportional.

In view of the foregoing similarity between the liquid clarifier of that copending patent application and the gas centrifuge of the present invention, the various embodiments of construction shown in that copending application are generically useful as the gas centrifuge of the present invention provided the total area of openings of the distributor means or the collector means is constructed on a basis in accordance with this aspect of the present invention rather than that specified in that copending application. For some of those embodiments of construction of the centrifugal clarifier, thus disclosed, when constructed with the relationship of total area of openings of the centrifuge in this aspect as a gas centrifuge of the present invention, these embodiments can be further changed for simplification in view of the fact that two gases are being withdrawn instead of the withdrawal of a liquid and a slurry or other liquid. Accordingly the disclosure in that copending application is hereby incorporated by reference. When thus constructed for use as a gas centrifuge, those embodiments would have the second collector means at or adjacent to the end portion of the housing that contains the first collector means rather than being located merely between the end portions of the housing.

The centrifuge of that aspect of the present invention is best illustrated by the preferred embodiment described below. That preferred embodiment of the centrifuge has a novel construction. By constructing it so that the total area of the openings of the distributor means or one of the collector means at the various annular chambers is as specified in that copending application for the construction as a centrifugal clarifier, there is obtained a useful embodiment of the centrifugal clarifier. Thus, the present invention includes in another aspect the preferred embodiment of the centrifuge stated without limitation of the relationship of the total areas of openings. In that other aspect of the centrifuge, the total area of each band of openings is preferably proportional to a value between about the second power and about the fourth power of the average radius of the associated annular chamber and, as a gas centrifuge, is preferably proportional to a value between about the third power and about the fourth power of that average radius.

The description that follows is directed for simplicity to the first aspect of construction that is useful as a gas centrifuge and to the other aspect of construction, with its set of pie-shaped chambers for at least one collector means, in its preferred use as a gas centrifuge.

The gas centrifuge of the invention includes a rotor, two outlet pipes and valved means connected to at least one of the outlet pipes. The centrifuge is connected, of course, to an inlet pipe that provides feed liquid to the centrifuge.

The rotor comprises a rotor shaft, a rotor housing, a set of partition walls within the housing, and distributor means and two collectors means within the housing.

The rotor housing encloses an elongated intermediate portion of the rotor shaft so as to provide around that intermediate portion of the shaft an elongated working space of annular cross section. The set of partition walls is mounted in that housing so that these walls are in that working space. These partition walls extend generally parallel to the longitudinal axis of the shaft. Preferably they are parallel to that axis. It is especially preferred that this set of partition walls constitute a set of equally spaced concentric cylindrical shells. It is also especially preferred that these shells be imperforate except for openings at various radial lines about their periphery for mounting of one of the two collector means mentioned above.

The partition walls extend from one end part of the intermediate portion of the working space to the other end part of that intermediate portion so as to provide a number of elongated parallel chambers through which the major flow of gas is across a centrifugal force field and generally parallel to the axis of rotation of the shaft rather than a radial flow. Of course, the centrifugal force field is provided by the rapid movement of the gas in these chambers about the axis of the shaft while the rotor is rotating.

The distributor means of the rotor extends radially outward from the rotor shaft. The distributor means is located within one end part of the housing. The distributor means has concentric sets of openings at different bands of radial distances from the axis of the shaft. Through these openings passes feed gas separately to one end of the generally parallel annular chambers provided by the set of partition walls.

One of the two collector means extends radially outward from the rotor shaft within the other end part of the housing and has concentric sets of openings at different bands of radial distances from the axis of the shaft. Each set of openings communicates that collector means with an annular chamber and each set is radially offset, preferably to the maximum degree of offset, from the average radial distance of that annular chamber to receive from that annular chamber gas of different concentration of compounds than the concentration of the compounds in the gas fed to the centrifuge.

The second collector means is located at the end part of the housing containing the first collector means or is located adjacent that end part of the housing.

The rotor shaft of the gas centrifuge of the invention is constructed with a number of longitudinal passageways. One is an inlet passageway for feed gas. This passageway extends inwardly to the end part of the intermediate portion of that shaft at which it is in the transverse plane containing said distributor means. At that inner end this passageway communicates with a radial passageway that communicates with the distributor means. A second longitudinal passageway in the rotor shaft extends inwardly to the intermediate portion of the shaft and communicates with a radial passageway that communicates with the first collector means that is located at the end part of the housing other than the end part containing the distributor means. A third longitudinal passageway is an outlet for gas collected by the second collector means. For this purpose the third longitudinal passageway extends inwardly to communicate with a radial passageway that is at the intermediate portion of the rotor shaft that is at a transverse plane passing through the intermediate portion of the housing. That radial passageway communicates with the second of the two collector means.

Although all three longitudinal passageways can extend inwardly from the same end of the rotor shaft to the extent described above, it is usually preferred for the simplest construction of the rotor that two of the longitudinal passageways extend inwardly from one end and the third passageway extends inwardly from the other end of the shaft. Of course, when longitudinal passageways extend inwardly from the same end of the rotor shaft, these passageways are concentric.

The gas centrifuge of the invention includes two outlet pipes, as mentioned above. One outlet pipe is connected to the rotor so as to communicate with one of the outlet longitudinal passageways, while the other outlet pipe is connected also to the rotor to communicate with the other of the outlet longitudinal passageways. The outlet pipe that thereby receives the collected gas that has a decreased concentration of desired gaseous compound as compared with feed gas has valved means mounted on it to control the rate of removal of that gas from its collector means and thus the overall flow rate of gas into the working space of the rotor. In this case the other outlet pipe receives the other separated gas that is enriched with respect to the desired compound as compared with the concentration of that compound in the feed gas. That other outlet pipe can have valved means mounted on it to control the rate of flow of removal of this enriched gas from the rotor.

The construction of the gas centrifuge of the invention in which the second collector means is adjacent that end of the housing is exemplified by various embodiments shown in my copending patent application mentioned above. For example, the second collector means can be sets of radially aligned downcomer pipes extending downwardly from the partition walls adjacent the end part of the housing containing the first collector means. The sets of these pipes are disposed at different radii so that the sets are arranged about the axis of the rotor shaft. Each pipe communicates with an opening in the corresponding partition wall so that the overall construction is seen to be a second collector means having sets of concentric openings at different bands of radial distances from the axis of the shaft. Each set of top openings of the downcomer pipes that communicate with the same annular chamber are seen to be radially offset from the average radial distance of that annular chamber to receive, from that annular chamber, gas of different concentration of compounds than the concentration of compounds in the gas fed to the centrifuge and, of course, of different concentration of compounds than the concentration of the compounds in the gas passing from that annular chamber to the first collector means.

Another embodiment shown in that copending patent application has radial pipes that are disposed about the axis of the shaft and that extend upwardly through the partition walls that form the annular chambers. This embodiment for the present invention has these radial pipes adjacent the end part containing the first collector means. As in the embodiment shown in that copending patent application, each of the radial pipes has openings at different radial distances. The openings for each radial pipe is located to be radially offset from the average radial distance of the annular chamber within which it is located. For communication with each annular chamber each radial pipe has the opening located so that the pipes provide a set of concentric openings communicating with the set of annular chambers. As in the embodiment with the downcomer pipes, this offset is opposite to the offset of the openings for the first collector means so that each radial pipe at its openings can receive, from each annular chamber, gas of different concentration of compounds than the concentration of compounds in the gas fed to the centrifuge and, of course, of different concentration of compounds than the concentration of compounds in the gas passing from the corresponding annular chamber to the first collector means.

The location of the second collector means at the end part of the housing that contains the first collector means is the preferred construction for the apparatus of the present invention. The preferred embodiment of the apparatus containing this construction is the novel gas centrifuge shown in the drawings and described below in detail. In this preferred construction each of the first collector means and the second collector means comprises a set of arcuately spaced pie-shaped chambers located in the same plane transverse to the rotor axis. Each pie-shaped chamber of a set is separated from adjacent pie-shaped chambers of the same set by two of the pie-shaped chambers of the other set. Thus the pie-shaped chambers of one set alternate with the pie-shaped chambers of the other set about the axis of the shaft.

Each of the two collector means of this preferred construction has a concentric set of openings that communicates with the annular chambers. The openings of each concentric set are located at the pie-shaped chambers of that collector means and are thus generally aligned in a radial direction for openings of a pie-shaped chamber that communicates with the annular chambers. Each ring of openings of the pie-shaped chambers of the first collector means is located so that those openings that communicate with a specific annular chamber are radially offset from the average radial distance of that annular chamber to receive, from that annular chamber, gas of different concentration of compounds than the concentration of compounds in the gas fed to the centrifuge. Similarly, each ring of openings of the pie-shaped chambers of the second collector is located so that the openings are radially offset from and on the opposite side of the average radial distance of that annular chamber to receive, from that annular chamber, gas of different concentration of compounds than the concentration of compounds in the gas fed to the centrifuge and, of course, of different concentration of compounds than the concentration of the compounds in the gas passing from that annular chamber to the first collector means.

In the preferred embodiment of the gas centrifuge of the invention that is described below, the concentric sets of openings of the first collector means provided by openings in its set of pie-shaped chambers are located offset from the radial distances of the annular chambers so that these openings are adjacent the inner portion of the annular chambers, i.e., adjacent the outer surfaces of the partition walls. In that example of the concentric sets of openings of the second collector means are located adjacent the outer part of the annular chambers so that they are adjacent the inner surfaces of the partition walls. In this case the first collector means is used to collect gas enriched in the annular chambers with respect to the desired gaseous compound that is lighter than the other compound of the initial feed gas.

In this preferred embodiment of the novel apparatus that is the preferred construction of the gas centrifuge of the invention, the bottom ends of both sets of pie-shaped chambers are spaced from the rotor shaft by an annular chamber at that end part of the housing and that end chamber has a number of openings communicating with the pie-shaped chambers of the first collector means, but does not have openings communicating with the pie-shaped chambers of the second collector means. Outwardly of that annular chamber that is at that end part of the housing the pie-shaped chambers of the second collector means have openings below the innermost annular chamber defined by the concentric set of partition walls. These openings communicate with an annular collection chamber between the rotor shaft and the working space defined by the housing and the innermost partition wall. That annular collection chamber communicates through the radial passageway and associated longitudinal passageway with the outlet pipe that is to receive the gas that is collected from the annular chambers and that is depleted in concentration of the desired gaseous compound. In the preferred construction that longitudinal passageway is concentric with and outside the inlet longitudinal passageway for feed gas. In the case of the other collected gas, that is enriched with respect to the desired gaseous compound of the feed gas, the annular chamber at the end of the housing containing the two collector means by the radial passageway communicates with the other outlet longitudinal passageway. That passageway extends outwardly from that end of the rotor shaft and communicates through a valve with the other outlet pipe.

A very important limitation present in the construction of the gas centrifuge of this invention is, as in the case of the construction of the centrifugal clarifier of the invention of my copending patent application mentioned above, the total area of the openings at each band of radial distance from the axis of rotation of the shaft for either the distributor means for feed gas or the collector means that receives gas of decreased concentration of desired compound from the working space within the rotor housing. This limitation as to total area of openings at each band of radial distance has been mentioned above where it has been indicated as to how it differs from that limitation for the centrifugal clarifier. It will be apparent from the foregoing description that for some embodiments of the gas centrifuge in which the collector means that receives that gas of reduced concentration of desired gaseous compound is constructed in such a manner that it is not feasible for that collector means to include this limitation of total area. In that case the limitation is necessarily used in the construction of the total area of openings at each band of radial distance for the distributor means.

In the construction in which the openings of the distributor means has total areas at each band to conform to the limitation mentioned above, each ring of openings is preferably located to be in alignment with the average radial height of the band of working space from which the feed gas flows through those openings. This construction thereby minimizes disturbance of flow of gas through each chamber that is generally parallel to the axis of the rotor.

DESCRIPTION OF THE DRAWINGS

FIG. 1 is an elevational view, partially broken away as a longitudinal section taken along line 1—1 of FIG. 5 and partially schematic, showing the preferred embodiment of the gas centrifuge of the present invention, in its use for separating feed gas into an enriched product gas that has a higher concentration of a lighter desired gaseous compound than its low concentration in the feed gas and a reject gas containing a lower concentration of that desired gaseous compound than in the feed gas.

FIG. 2 is a fragmentary cross sectional view taken along line 2—2 of FIG. 1.

FIG. 3 is a fragmentary cross sectional view taken along line 3—3 of FIG. 1.

FIG. 4 is a fragmentary longitudinal section of this embodiment of the gas centrifuge taken along line 4—4 of FIG. 3.

FIG. 5 is a fragmentary cross sectional view taken along line 5—5 of FIG. 1.

DETAILED DESCRIPTION

As seen in FIG. 1, the preferred embodiment of the gas centrifuge of the invention has a rotor generally indicated at 6, an outlet pipe 7 to receive enriched product gas from the centrifuge, another outlet pipe 8 to receive reject gas from the centrifuge, a valve 9 in pipe 7 and a valve 10 in pipe 8.

In the following description it is assumed for purpose of illustration that the gas fed to the centrifuge, that is, feed gas, is essentially a mixture of two gases containing about 1% of a lighter gas and the balance substantially being a heavier gas, e.g., gaseous uranium hexafluoride in which the uranium is natural uranium so that the lighter gaseous compound is $U^{235}F_6$. In that case the enriched product gas is $UF_6$ containing a higher concentration of $U^{235}$ than present in the feed gas and, of course, the reject gas is $UF_6$ containing a lower concentration of $U^{235}$ than present in the feed gas.

The rotor 6 has a rotor shaft 11. The elongated intermediate portion of shaft 11 is enclosed by a rotor housing generally indicated at 12. Within housing 12 is an elongated working space of annular cross section. The housing 12 includes a pair of circular end discs 13 and 14 mounted on shaft 11 at the opposite ends of the intermediate portion of shaft 11 for rotation with shaft 11. The housing 12 also includes a cylindrical shell 15 connected at its ends to the peripheral margin of discs 13 and 14 to complete the enclosure of the intermediate portion of shaft 11.

The shaft 11 has a longitudinal inlet passageway 16 that extends inwardly from one end of shaft 11 to one end of its intermediate portion. The passageway 16, adjacent its inner end, communicates with a radial passageway 17 that communicates with that end of the working space within housing 12. That end of shaft 11 has a longitudinal outlet passageway 18 that is coaxial with passageway 16. The passageway 16 extends outwardly through and beyond the outer end portion of passageway 18 that extends inwardly further than passageway 16. The outer end portion of passageway 18 communicates with a radial passageway 19 that communicates with outlet pipe 8. The other end of shaft 11 has a longitudinal outlet passageway 20 that, at its inner end portion, communicates with a radial passageway 21 that communicates with the other end of the working space within housing 12.

The outlet pipes 7 and 8 are connected to shaft 11 by a conventional, well-known construction whereby pipes 7 and 8 remain stationary, while shaft 11 rotates. During this relative movement pipes 7 and 8 remain in communication with outlet passageway 20 and outlet passageway 18, respectively, the latter communication being through radial passageway 19. Similarly, passageway 16 is in communication with an inlet pipe (not shown). Conventional constructions that provide these communications between an inlet pipe or outlet pipes and a revolving rotary shaft are disclosed in numerous patents including U.S. Pat. Nos. 3,344,982 and 3,344,983, mentioned above. Also the centrifuge is constructed in a conventional manner, e.g., as shown in those two patents, to include a driven sheave (not shown) to drive shaft 11 at a desired rotational speed. Of course, shaft 11 is rotatably mounted with bearings (not shown) on a suitable supporting structure (not shown).

Within rotor housing 12 and spaced from discs 13 and 14 are circular discs 24 and 25, respectively. The disc 24 has concentric bands of holes 26. The chamber defined by disc 13 and housing 12 and disc 24 with its holes 26 provides distributor means at one end of housing 12 whereby feed gas is distributed through holes 26 to the working space within housing 12 between discs 24 and 25.

The disc 25 has a set of concentric bands of holes 27 and a second set of concentric bands of holes 28. A number of radial narrow plates 30 are mounted between disc 14 and disc 25 to separate the chamber between discs 14 and 25 and inwardly from housing shell 15 into a number of pie-shaped chambers. The narrow plates 30 extend inwardly to a narrow cylindrical shell 31 that is mounted between discs 14 and 25. The diameter of shell 31 is greater than that of the outer diameter of shaft 11 to provide an annular collection chamber extending from shaft 11 to a radial distance less than the location of the innermost ring of holes 27. Of course, narrow plates 30 and narrow shell 31 are mounted to rotate with housing 12 within which they are located at one end.

The pie-shaped chambers formed between discs 14 and 25 and between cylindrical shells 15 and 31 are disposed about the axis of shaft 11 and constitute two sets of pie-shaped chambers in which, for each set, each pie-shaped chamber is spaced from the next adjacent pie-shaped chambers by a pie-shaped chamber of the other set. Thus the pie-shaped chambers of one set alternate with the pie-shaped chambers of the other set about the axis of shaft 11. The holes 27 are located so that they are at the set of pie-shaped chambers that constitute the first collector means, while holes 28 are located so that they are at the other set of pie-shaped chambers that constitute the second collector means.

Mounted between discs 13 and 24 are radial baffles 33 that extend from adjacent shaft 11 to a position adjacent shell 15. The baffles 33 are connected to disc 13, or disc 24, or both, so that baffles 33 move about the axis of shaft 11 when that shaft and, of course, housing 12, are rotated.

The radial passageway 17 communicates with the space between discs 13 and 24 that provide between shaft 11 and shell 15 the distributor means of the centrifuge. The radial baffles 33 impart rotational speed to feed gas in the distributor means so that feed gas is subjected to increased centrifugal force before passage through holes 26. Most of the energy used to provide this rotational speed is recovered when collected gas in the first collector means, after passage through holes 27 of disc 25, and the other collected gas in the second collector means, after passage through holes 28 of disc 25, pass radially inwardly in the first and second collector means, respectively. This recovery of energy is due to the presence of narrow plates 30 that serves as radial baffles of rotor 6 as well as serving as walls separating the alternating pie-shaped chambers of the two collector means. In the construction of this preferred embodiment of the centrifuge all of the gas passes to outlet passageways in a manner that utilizes these radial plates 30 to recover energy.

A number of elongated parallel annular chambers between discs 24 and 25 are provided by a number of equally spaced concentric cylindrical shells 35 connected at their ends to discs 24 and 25 so that shells 35 are in the working space mentioned above. Within these annular chambers, the heavier gaseous compound of the gas feed is moved radially outward toward the outermost portion of the annular chambers, i.e., toward the inner surface of each of shells 35 for all but the outermost of the annular chambers where the movement is to the inner surface of housing shell 15. As a result, the lighter gaseous compound in the gas that is adjacent the innermost portion of these annular chambers, i.e., adjacent the outer surfaces of cylindrical shells 35 that form one wall of all of the annular chambers, is present in a higher concentration than present in the feed gas.

It is seen from FIG. 1 that in the working space provided by these annular chambers the general or major direction of flow of gas from disc 24 to disc 25 is generally parallel to the axis of rotation of the rotor, i.e., the axis of shaft 11. As a result, gas, having a composition with a greater content of the lighter gaseous compound than the feed gas from the downstream end of this flow, passes through holes 27 into that set of the alternating pie-shaped chambers having holes 27. This gas passing through holes 27 is from that end of the innermost portion of the annular chambers. At the same time, gas having a composition with a lesser content of the lighter gaseous compound than the feed gas, from the downstream end of this flow through the elongated annular chambers, passes through holes 28 into that set of the alternating pie-shaped chambers having holes 28. This gas passing through holes 28 is from that end of the outermost portion of the annular chambers.

As seen in FIGS. 2, 3 and 5, holes 26 are indicated as being parallel holes centrally located between the radial lines at which baffles 33 are located and centrally of the height of the annular chambers, while holes 27 and 28 are indicated as being arcuate slots in alignment with the innermost portions and the outermost portions, respectively, of the annular chambers and extending the full distance between adjacent narrow radial plates 30. The shapes of holes 26, 27 and 28 are merely illustrative. The important limitation is with respect either to the total area of each ring of holes 26, communicating with a specific annular chamber, relative to the total area of rings of holes 26 at other radial distances, i.e., communicating with other annular chambers or the total area of each ring of holes 27 or 28, communicating with a specific annular chamber, relative to the total area of rings of holes 27 or 28, respectively, at other radial distances, i.e., communicating with other annular chambers.

Either of the collector means may have openings, to the annular chambers, that are constructed with this limitation of total areas, rather than such limitation being included in the construction of the distributor means with its holes 26. The collector means having the holes with such limitation of total areas is the collector means that receives from the annular chambers the major flow of gas, i.e., the gas that has a lesser concentration of desired gaseous compound than the feed gas. In the illustration being described, this gas is the reject gas and in that case holes 28 in the various rings of holes 28 are constructed so that the total areas of the rings of holes 28 are relative to the other total areas of rings of holes 28 in accordance with this limitation.

In the event that centrifuge is constructed to be used for separating a desired heavier gaseous compound from a feed gas in which it is desired to obtain a product gas that has a higher concentration of that heavier gaseous compound, holes 27 at the various rings of holes 27 are constructed so that the total area of holes 27 for each ring is relative to those in the other rings to satisfy this limitation with regard to total area of holes. In that case holes 27 would be made in accordance with this limitation.

The limitation expressed above is the limitation that the total area of a set of openings of the distributor means (or of one of the collector means when appropriate) communicating with a specific annular chamber is proportional to a value between about the third power and about the fourth power of the average radius of the annular chamber at which the ring of holes is located to provide a linear flow of gas through each annular chamber proportional to a value between about the third power and about the fourth power of that average radius of the annular chamber.

The narrow cylindrical shell 31 has a number of holes 37 about its periphery in alignment with the pie-shaped chambers containing holes 27 so that gas passing through holes 27 into those pie-shaped chambers then passes through holes 37 of shell 31 into the narrow annular chamber between discs 14 and 25 and between shell 31 and shaft 11. From that chamber the enriched product gas passes through radial passageway 21, through longitudinal outlet passageway 20 and then into outlet pipe 7. The control of flow of this gas through pipe 7 is controlled by valve 9 that determines by its setting the rate of removal of enriched product gas from the elongated parallel annular chambers provided between housing shell 15 and shell 11.

As seen in FIGS. 4 and 5, disc 25 has a ring of holes 38 disposed above the radial height of shell 31 and below the radial height of innermost cylindrical shell 35. The holes 38 are disposed about the axis of shaft 11 so that they are in alignment with the set of alternating pie-shaped chambers that comprise the second collector means and that have holes 28 as described above. Because innermost shell 35 is concentric with and spaced from shaft 11, there is between them an elongated annular collection chamber. Adjacent disc 24 shaft 11 has a radial passageway 39 that communicates that elongated collection chamber with longitudinal outlet passageway 18. As a result, reject gas passing through holes 28 into the second collector means provided by the second set of pie-shaped chambers passes through holes 37 into and through this elongated annular collection chamber and then passes via passageways 39 and 18 to radial passageway 19 and finally into outlet pipe 8. The valve 10 in outlet pipe 8 is set to control the rate of flow of reject gas from the elongated parallel annular chambers provided by the presence of shells 35 between housing shell 15 and shaft 11. The valve 10 controls the total flow of gas through the set of elongated annular chambers through which gas flows from the distributor means to the first and second collector means.

Many modifications of the centrifuge of the present invention will be apparent from this detailed description and the summary of the invention. The foregoing description of one aspect of construction of the centrifuge in the form of its preferred embodiment as a gas centrifuge has been presented for purpose of illustration only. The invention is limited only by the claims that follow.

I claim:

1. A centrifuge for separation of a fluid containing two compounds of different density into a fluid product enriched in one of the compounds and a fluid having a reduced concentration of that compound, which includes:

a rotor comprising:

a rotor shaft;

a rotor housing to enclose an elongated intermediate portion of said shaft so as to provide around said intermediate portion of said shaft an elongated working space of annular cross section;

a set of partition wall means in said working space of said housing, and concentric with and extending generally parallel to the longitudinal axis of said shaft from one end part of said intermediate portion to the other end part of said intermediate portion providing a number of elongated annular chambers about said axis for major flow of fluid in said working space across a centrifugal force field and generally parallel to said axis;

distributor means extending radially outward from said shaft within one end part of said housing and having concentric sets of openings at different bands of radial distances from said axis to furnish feed fluid separately to said chambers;

first collector means extending radially outward from said shaft within the other end part of said housing and having concentric sets of openings at different bands of radial distances from said axis that are for each band offset in one radial direction with respect to the average radius of that elongated annular chamber communicating with said first collector means by that band of set of openings to receive one of the separated fluids; and second collector means located at said other end part of said housing or between said end parts of said housing but adjacent said other end part of said housing and having concentric sets of openings at different bands of radial distances from said axis that are for each band offset in the other radial direction with respect to the average radius of that elongated annular chamber communicating with said second collector means by that band of set of openings to receive the other separated fluid, said rotor shaft having:

a longitudinal inlet passageway extending inwardly to said one end part of said intermediate portion of the shaft;

a radial passageway communicating said inner end of said inlet passageway with said distributor means;

a first longitudinal outlet passageway extending inwardly to said other end part of said intermediate portion of the shaft;

a radial passageway communicating said inner end of said first outlet passageway with said first collector means;

a second longitudinal outlet passageway extending inwardly to said intermediate portion of the shaft; and a radial passageway communicating said inner end of said second outlet passageway with said second collector means;

a first outlet pipe connected to said rotor to receive from one of said first and second outlet passageways one of the separated fluids;

a second outlet pipe connected to said rotor to receive from the other outlet passageway the other separated fluid; and valved means mounted on said first outlet pipe to control the rate of removal of the separated fluid by said first outlet pipe, the total area of said openings at each band of radial distance from said axis for one of said distributor means for feed fluid and said first and second collector means to receive separated fluids being proportional to a value between about the third power and about the fourth power of the average radius of the elongated annular chamber with which the set of openings is in alignment.

2. The centrifuge of claim 1 wherein:

said rotor housing comprises a generally cylindrical housing shell and two circular discs mounted on said shaft and connected at their periphery to the ends of said shell;

said set of partition wall means comprises a set of equally spaced concentric generally cylindrical shells spaced from said shaft and said housing shell in said working space;

said distributor means within said one end part of said housing comprises a circular inlet disc mounted on said rotor shaft, extending from said shaft to said housing shell, and spaced from said one end part of said housing to provide a cylindrical inlet chamber, said inlet disc having said concentric sets of openings at different bands of radial distances from said axis; and said first collector means within said other end part of said housing comprises a circular outlet disc mounted on said rotor shaft, extending from said shaft to said housing shell, and spaced from said other end part of said housing to provide a cylindrical outlet chamber, said outlet disc having said concentric sets of openings at different bands of radial distances from said axis with each set being in alignment with one of the outer and inner peripheral portions of the associated parallel chamber provided by said concentric shells, said concentric shells extending from said inlet disc to said outlet disc.

3. The centrifuge of claim 2 wherein each set of said concentric sets of openings in said circular inlet disc is in alignment with an intermediate annular portion of that parallel chamber provided by said concentric shells in said working space.

4. The centrifuge of claim 3 wherein said cylindrical inlet chamber contains radial baffles mounted to rotate with said shaft.

5. The centrifuge of claim 4 wherein the total area of said openings at each band of radial distance from said axis for one of said distributor means for said feed fluid and said first and second collector means to receive separated fluids is proportional to about the 3.5 power of the average radius of the elongated annular chamber with which the set of openings is in alignment.

6. A centrifuge for separation of a fluid containing two compounds of different density into a fluid product enriched in one of the compounds and a fluid having a reduced concentration of that compound, which includes:

a rotor comprising:

a rotor shaft;

a rotor housing to enclose an elongated intermediate portion of said shaft so as to provide around said intermediate portion of said shaft an elongated working space of annular cross section, said rotor housing comprising a generally cylindrical housing shell and two circular discs mounted on said shaft and connected at their periphery to the ends of said shell;

a set of equally spaced concentric generally cylindrical shells concentric with and spaced from said shaft and said housing shell in said working space, providing a number of elongated annular chambers about said axis for major flow of fluid in said working space across a centrifugal force field and generally parallel to said axis;

distributor means extending radially outward from said shaft within one end part of said housing and having first concentric sets of openings at different bands of radial distances from said axis to furnish, at one end of said concentric shells, said fluid separately to said chambers;

first collector means located within the other end part of said housing and comprising a first set of pie-shaped chambers spaced from one another about the axis of said shaft and extending from said housing shell radially inward to a location beyond the innermost of said set of concentric shells, each pie-shaped chamber having a wall at the other end of said set of concentric shells, said walls of said first set of pie-shaped chambers being generally transverse to the axis of said shaft and having concentric sets of openings at different bands of radial distances from said axis with each set being in alignment with one of the outer and inner peripheral portions of the associated parallel chamber provided by said concentric shells to receive one of the separated fluids, said first collector means further including a first collection chamber and each of said first pie-shaped chambers having an opening communicating with said first collection chamber; and second collector means located also within the other end part of said housing and comprising a second set of pie-shaped chambers spaced from one another about the axis of said shaft, being located at the same transverse plane as said first set of pie-shaped chambers, and extending from said housing shell radially inward to a location beyond the innermost of said set of concentric shells, each pie-shaped chamber having a wall at that other end of said set of concentric shells, said walls of said second set of pie-shaped chambers being generally transverse to the axis of said shaft and having concentric sets of openings at different bands of radial distances from said axis with each set being in alignment with the other of the outer and inner peripheral portions of the associated parallel chamber provided by said concentric shells to receive the other separated fluid, said second collector means further including a second collection chamber and each of said second pie-shaped chambers having an opening communicating with said second collection chamber, said rotor shaft having:

a longitudinal inlet passageway extending inwardly to said one end part of said intermediate portion of the shaft;

a radial passageway communicating said inner end of said inlet passageway with said distributor means;

a first longitudinal outlet passageway extending inwardly to said other end part of said intermediate portion of the shaft;

a radial passageway communicating said inner end of said first outlet passageway with said first collection chamber of said first collection means;

a second longitudinal outlet passageway extending inwardly to said intermediate portion of the shaft; and a radial passageway communicating said inner end of said second outlet passageway with said second collection chamber of said second collector means;

a first outlet pipe connected to said rotor to receive from one of said first and second outlet passageways one of the separated fluids;

a second outlet pipe connected to said rotor to receive from the other outlet passageway the other separated fluid; and valved means mounted on said first outlet pipe to control the rate of removal of the separated fluid by said first outlet pipe.

7. The centrifuge of claim 6 wherein:

said distributor means within said one end part of said housing comprises a circular inlet disc mounted on said rotor shaft, extending from said shaft to said housing shell, and spaced from said one end part of said housing to provide a cylindrical inlet chamber, said inlet disc having said concentric sets of openings at different bands of radial distances from said axis; and said concentric shells extend to said inlet disc.

8. The centrifuge of claim 7 wherein each set of said concentric sets of openings in said circular inlet disc is in alignment with an intermediate annular portion of that parallel chamber provided by said concentric shells in said working space.

9. The centrifuge of claim 8 wherein said cylindrical inlet chamber contains radial baffles mounted to rotate with said shaft.

10. The centrifuge of claim 6 wherein:

said circular disc of the housing at said other end part of said housing provides a common wall of all of said first and second sets of pie-shaped chambers of said first and second collector means; and said walls of said first and second sets of said pie-shaped chambers of said first and second collector means at that other end of said set of concentric shells are provided by an outlet disc extending from said shaft to said housing shell that is a common wall for all of said first and second sets of pie-shaped chambers.

11. The centrifuge of claim 10 wherein:

said first collection chamber comprises a common cylindrical shell between that end disc of the housing and said outlet disc, said common cylindrical shell: being spaced from said shaft;

having a radius less than the radius of the innermost of said set of concentric shells;

providing a common inner wall for said first and second sets of pie-shaped chambers; and having said openings in alignment with said first set of pie-shaped chambers to provide communication between those pie-shaped chambers and said first collection chamber; and said second collection chamber is provided by said shaft, said innermost shell of said set of concentric shells, said inlet disc and said outlet disc, communicates with said second set of pie-shaped chambers through openings in said outlet disc that are:

arcuately offset with respect to said openings in said common cylindrical shell and in said outlet disc that are at said first set of pie-shaped chambers;

radially inward of said innermost shell of said set of concentric shells and radially outward of said common cylindrical shell; and in radial alignment with said second set of pie-shaped chambers.

12. The centrifuge of claim 11 wherein:

said first and second sets of pie-shaped chambers are disposed about the axis of said shaft in an alternating manner; and each wall of both sets of pie-shaped chambers, that is radial and extends between said outlet disc and said housing disc at that end of said housing is a wall common to a pie-shaped chamber of one of said sets and to a pie-shaped chamber of one of the other of said sets, each of said walls being a radial plate that extends from the common cylindrical shell to the housing shell.

13. The centrifuge of claim 6 wherein the total area of said openings at each band of radial distance from said axis for one of said distributor means for feed fluid and said first and second collector means to receive separated fluid is proportional to a value between about the second and about the fourth power of the average radius of the elongated annular chamber with which the set of openings is in alignment.

14. The centrifuge of claim 13 wherein:

said distributor means within said one end part of said housing comprises a circular inlet disc mounted on said rotor shaft, extending from said shaft to said housing shell, and spaced from said one end part of said housing to provide a cylindrical inlet chamber, said inlet disc having said concentric sets of openings at different bands of radial distances from said axis;

each set of said concentric sets of openings in said circular inlet disc is in alignment with an intermediate annular portion of that parallel chamber provided by said concentric shells in said working space; and said concentric shells extend to said inlet disc.

15. The centrifuge of claim 14 wherein:

said circular disc of the housing at said other end part of said housing provides a common wall of all of said first and second sets of pie-shaped chambers of said first and second collector means;

said walls of said first and second sets of said pie-shaped chambers of said first and second collector means at that other end of said set of concentric shells are provided by an outlet disc extending from said shaft to said housing shell that is a common wall for all of said first and second sets of pie-shaped chambers;

said first collection chamber comprises a common cylindrical shell between that end disc of the housing and said outlet disc, said common cylindrical shell:

being spaced from said shaft;

having a radius less than the radius of the innermost of said set of concentric shells;

providing a common inner wall for said first and second sets of pie-shaped chambers; and having said openings in alignment with said first set of pie-shaped chambers to provide communication between those pie-shaped chambers and said first collection chamber;

said first and second sets of pie-shaped chambers are disposed about the axis of said shaft in an alternating manner; and each wall of both sets of pie-shaped chambers, that is radial and extends between said outlet disc and said housing disc at that end of said housing is a wall common to a pie-shaped chamber of one of said sets and to a pie-shaped chamber of one of the other of said sets, each of said walls being a radial plate that extends from the common cylindrical shell to the housing shell.

16. The centrifuge of claim 6 wherein the total area of said openings at each band of radial distance from said axis for one of said distributor means for feed fluid and said first and second collector means to receive separated fluid is proportional to about the second power of the average radius of the elongated annular chamber with which the set of openings is in alignment.

17. The centrifuge of claim 16 wherein:

said distributor means within said one end part of said housing comprises a circular inlet disc mounted on said rotor shaft, extending from said shaft to said housing shell, and spaced from said one end part of said housing to provide a cylindrical inlet chamber, said inlet disc having said concentric sets of openings at different bands of radial distances from said axis;

each set of said concentric sets of openings in said circular inlet disc is in alignment with an intermediate annular portion of that parallel chamber provided by said concentric shells in said working space; and said concentric shells extend to said inlet disc.

18. The centrifuge of claim 17 wherein:

said circular disc of the housing at said other end part of said housing provides a common wall of all of said first and second sets of pie-shaped chambers of said first and second collector means;

said walls of said first and second sets of said pie-shaped chambers of said first and second collector means at that other end of said set of concentric shells are provided by an outlet disc extending from said shaft to said housing shell that is a common wall for all of said first and second sets of pie-shaped chambers;

said first collection chamber comprises a common cylindrical shell between that end disc of the housing and said outlet disc, said common cylindrical shell:

being spaced from said shaft;

having a radius less than the radius of the innermost of said set of concentric shells;

providing a common inner wall for said first and second sets of pie-shaped chambers; and having said openings in alignment with said first set of pie-shaped chambers to provide communication between those pie-shaped chambers and said first collection chamber;

said first and second sets of pie-shaped chambers are disposed about the axis of said shaft in an alternating manner; and each wall of both sets of pie-shaped chambers, that is radial and extends between said outlet disc and said housing disc at that end of said housing is a wall common to a pie-shaped chamber of one of said sets and to a pie-shaped chamber of one of the other of said sets, each of said walls being a radial plate that extends from the common cylindrical shell to the housing shell.

19. The centrifuge of claim 6 wherein the total area of said openings at each band of radial distance from said axis for one of said distributor means for feed fluid and said first and second collector means to receive separated fluid is proportional to a value between about the third power and about the fourth power of the average radius of the elongated annular chamber with which the set of openings is in alignment.

20. The centrifuge of claim 19 wherein:

said distributor means within said one end part of said housing comprises a circular inlet disc mounted on said rotor shaft, extending from said shaft to said housing shell, and spaced from said one end part of said housing to provide a cylindrical inlet chamber, said inlet disc having said concentric sets of openings at different bands of radial distances from said axis;

each set of said concentric sets of openings in said circular inlet disc is in alignment with an intermediate annular portion of that parallel chamber provided by said concentric shells in said working space; and said concentric shells extend to said inlet disc.

21. The centrifuge of claim 20 wherein:

said circular disc of the housing at said other end part of said housing provides a common wall of all of said first and second sets of pie-shaped chambers of said first and second collector means;

said walls of said first and second sets of said pie-shaped chambers of said first and second collector means at that other end of said set of concentric shells are provided by an outlet disc extending from said shaft to said housing shell that is a common wall for all of said first and second sets of pie-shaped chambers;

said first collection chamber comprises a common cylindrical shell between that end disc of the housing and said outlet disc, said common cylindrical shell:

being spaced from said shaft;

having a radius less than the radius of the innermost of said set of concentric shells;

providing a common inner wall for said first and second sets of pie-shaped chambers; and having said openings in alignment with said first set of pie-shaped chambers to provide communication between those pie-shaped chambers and said first collection chamber;

said first and second sets of pie-shaped chambers are disposed about the axis of said shaft in an alternating manner; and each wall of both sets of pie-shaped chambers, that is radial and extends between said outlet disc and said housing disc at that end of said housing is a wall common to a pie-shaped chamber of one of said sets and to a pie-shaped chamber of one of the other of said sets, each of said walls being a radial plate that extends from the common cylindrical shell to the housing shell.

22. The centrifuge of claim 21 wherein the total area of said openings at each band of radial distance from said axis for one of said distributor means for said fluid and said first and second collector means to receive separated fluids is proportional to about the 3.5 power of the average radius of the elongated annular chamber with which the set of openings is in alignment.

23. The centrifuge of claim 21 wherein said second collection chamber is provided by said shaft, said innermost shell of said set of concentric shells, said inlet disc and said outlet disc, communicates with said second set of pie-shaped chambers through openings in said outlet disc that are:

arcuately offset with respect to said openings in said common cylindrical shell and in said outlet disc that are at said first set of pie-shaped chambers;

radially inward of said innermost shell of said set of concentric shells and radially outward of said common cylindrical shell; and in radial alignment with said second set of pie-shaped chambers.

* * * * *